US008629736B2

(12) United States Patent
Tamaru

(10) Patent No.: US 8,629,736 B2
(45) Date of Patent: Jan. 14, 2014

(54) DIRECTIONAL COUPLER

(71) Applicant: Murata Manufacturing Co., Ltd., Nagaokakyo (JP)

(72) Inventor: Ikuo Tamaru, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/947,375

(22) Filed: Jul. 22, 2013

(65) Prior Publication Data

US 2013/0300518 A1 Nov. 14, 2013

Related U.S. Application Data

(63) Continuation of application No. PCT/JP2012/051047, filed on Jan. 19, 2012.

(30) Foreign Application Priority Data

Mar. 14, 2011 (JP) ..... 2011-055323

(51) Int. Cl.
*H01P 5/12* (2006.01)
*H01P 3/08* (2006.01)

(52) U.S. Cl.
USPC ..... 333/109; 333/116

(58) Field of Classification Search
USPC ..... 333/109, 110, 111, 112, 116
See application file for complete search history.

(56) References Cited

U.S. PATENT DOCUMENTS

| | | | | |
|---|---|---|---|---|
| 7,218,186 | B2 * | 5/2007 | Chen | 333/116 |
| 8,289,102 | B2 * | 10/2012 | Yamamoto et al. | 333/116 |
| 8,314,663 | B2 * | 11/2012 | Tamaru et al. | 333/109 |
| 2004/0113716 | A1 | 6/2004 | Hilal et al. | |
| 2005/0212617 | A1 | 9/2005 | Chen | |
| 2012/0161897 | A1 | 6/2012 | Tamaru et al. | |

FOREIGN PATENT DOCUMENTS

| | | | |
|---|---|---|---|
| JP | 08-237012 | A | 9/1996 |
| JP | 10-290108 | A | 10/1998 |
| JP | 2001-044719 | A | 2/2001 |
| JP | 2004-289797 | A | 10/2004 |
| JP | 2009-044303 | A | 2/2009 |
| WO | 2011/074370 | A1 | 6/2011 |

OTHER PUBLICATIONS

Official Communication issued in International Patent Application No. PCT/JP2012/051047, mailed on Apr. 17, 2012.

* cited by examiner

*Primary Examiner* — Dean O Takaoka
(74) *Attorney, Agent, or Firm* — Keating & Bennett, LLP

(57) ABSTRACT

In a directional coupler, a first low pass filter includes a first coil that is connected between a first outer electrode and a main line and has a characteristic in which attenuation increases with increasing frequency in a certain frequency band. A second low pass filter includes a second coil that is connected between a second outer electrode and the main line and has a characteristic in which attenuation increases with increasing frequency in the certain frequency band. A high pass filter is connected, in parallel to the main line, between a point between the first coil and the first outer electrode and a point between the second coil and the second outer electrode and has a characteristic in which attenuation decreases with increasing frequency in the certain frequency band.

18 Claims, 3 Drawing Sheets

DIRECTIONAL COUPLER

BACKGROUND OF THE INVENTION

1. Field of the Invention

The present invention relates to a directional coupler and more particularly relates to a directional coupler that is preferably used in wireless communication devices or other devices that perform communication by using high-frequency signals.

2. Description of the Related Art

A directional coupler described in Japanese Unexamined Patent Application Publication No. 8-237012 is a known example of an existing directional coupler. The directional coupler is formed by stacking a plurality of dielectric layers, on which coil-shaped conductors and ground conductors are formed, on top of one another. Two coil-shaped conductors are provided. One of the coil-shaped conductors constitutes a main line and the other coil-shaped conductor constitutes a sub line. The main line and the sub line are electromagnetically coupled to each other. The coil-shaped conductors are interposed between the ground conductors in a stacking direction. A ground potential is applied to the ground conductors. In the above-described directional coupler, when a high-frequency signal is input to the main line, a high-frequency signal having power proportional to the power of the foregoing high-frequency signal is output from the sub line.

However, there is a drawback with the directional coupler described in Japanese Unexamined Patent Application Publication No. 8-237012, in that the degree of coupling between the main line and the sub line increases as the frequency of a high-frequency signal input to the main line increases (that is, the degree-of-coupling characteristic is not uniform). As a result, even if high-frequency signals having the same power are input to the main line, when the frequencies of the high-frequency signals vary, the power of each of the high-frequency signals output from the sub line varies. Hence, an IC connected to the sub line has to have a function of correcting the power of a high-frequency signal on the basis of the frequency of the high-frequency signal.

SUMMARY OF THE INVENTION

Preferred embodiments of the present invention provide a directional coupler that has a near-uniform degree-of-coupling characteristic.

A directional coupler according to a preferred embodiment of the present invention is a directional coupler that is used in a certain frequency band. The directional coupler includes a first terminal, a second terminal, a third terminal, a fourth terminal, a main line that is connected between the first terminal and the second terminal, a sub line that is connected between the third terminal and the fourth terminal and that is electromagnetically coupled to the main line, a first low pass filter that includes a first coil which is connected between the first terminal and the main line and that has a characteristic in which attenuation increases with increasing frequency in the certain frequency band, a second low pass filter that includes a second coil which is connected between the second terminal and the main line and that has a characteristic in which attenuation increases with increasing frequency in the certain frequency band, and a high pass filter that is connected, in parallel to the main line, between a point between the first coil and the first terminal and a point between the second coil and the second terminal and that has a characteristic in which attenuation decreases with increasing frequency in the certain frequency band.

According to various preferred embodiments of the present invention, a degree-of-coupling characteristic in a directional coupler is close to uniform.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

A directional coupler according to preferred embodiments of the present invention will be described below.

Figure 1:
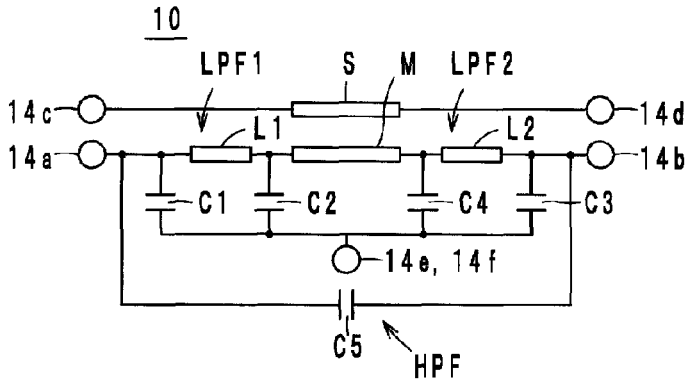
FIG. 1 is an equivalent circuit diagram of a directional coupler according to a preferred embodiment of the present invention.

FIG. 1 is an equivalent circuit diagram of a directional coupler 10 according to a preferred embodiment of the present invention.

A circuit configuration of the directional coupler 10 will be described. The directional coupler 10 is used in a certain frequency band. A non-limiting example of the certain frequency band is a band of 824 MHz to 2690 MHz in the case of a high-frequency signal having a frequency of 824 MHz to 894 MHz (BAND 5 of W-CDMA) and a high-frequency signal having a frequency of 2500 MHz to 2690 MHz (BAND 7 of W-CDMA) are input to the directional coupler 10. Hereinafter, the frequency band of 824 MHz to 894 MHz (BAND 5 of W-CDMA) is termed a frequency band B1, and the frequency band of 2500 MHz to 2690 MHz (BAND 7 of W-CDMA) is termed a frequency band B2.

As the circuit configuration, the directional coupler 10 includes outer electrodes (terminals) 14*a* to 14*f*, a main line M, a sub line S, low pass filters LPF1 and LPF2, and a high pass filter HPF. The main line M is connected between the outer electrodes 14*a* and 14*b*. The sub line S is connected between the outer electrodes 14*c* and 14*d* and is electromagnetically coupled to the main line M.

The low pass filter LPF1 is connected between the outer electrode 14*a* and the main line M and has a characteristic in which attenuation increases with increasing frequency in the certain frequency band. The low pass filter LPF1 is a π-type low pass filter that includes capacitors C1 and C2, and a coil L1. The coil L1 is connected between the outer electrode 14*a* and the main line M. The capacitor C1 is connected between a point between the coil L1 and the outer electrode 14*a*, and the outer electrodes 14*e* and 14*f*. The capacitor C2 is connected between a point between the main line M and the coil L1, and the outer electrodes 14*e* and 14*f*.

The low pass filter LPF2 is connected between the outer electrode 14*b* and the main line M and has a characteristic in which attenuation increases with increasing frequency in the certain frequency band. In the directional coupler 10, the low pass filter LPF1 and the low pass filter LPF2 have the same characteristic. The low pass filter LPF2 preferably is a π-type low pass filter that includes capacitors C3 and C4, and a coil L2. The coil L2 is connected between the outer electrode 14*b* and the main line M. The capacitor C3 is connected between a point between the coil L2 and the outer electrode 14*b*, and the outer electrodes 14*e* and 14*f*. The capacitor C4 is connected between a point between the main line M and the coil L2, and the outer electrodes 14*e* and 14*f*.

The high pass filter HPF is connected, in parallel to the main line M, between a point between the coil L1 and the outer electrode 14*a* and a point between the coil L2 and the outer electrode 14*b*, and has a characteristic in which attenuation decreases with increasing frequency in the certain frequency band. The high pass filter HPF preferably includes a capacitor C5.

In the above-described directional coupler 10, the outer electrode 14*a* preferably defines an input port and the outer electrode 14*b* preferably defines an output port. The outer electrode 14*c* preferably defines a coupling port and the outer electrode 14*d* preferably defines a termination port that is terminated with 50Ω, for example. The outer electrodes 14*e* and 14*f* preferably define ground ports that are grounded. When a high-frequency signal is input to the outer electrode 14*a*, the high-frequency signal is output from the outer electrode 14*b*. In addition, because the main line M and the sub line S are electromagnetically coupled to each other, a high-frequency signal having power proportional to the power of the high-frequency signal is output from the outer electrode 14*c*.

Figure 2:
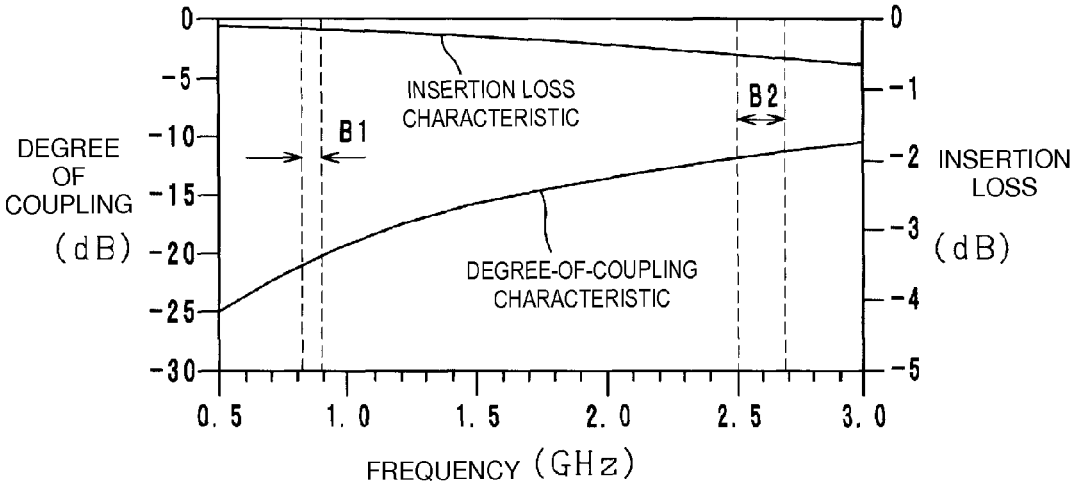
FIG. 2 is a graph illustrating an insertion loss characteristic and a degree-of-coupling characteristic of an existing directional coupler, which is the same as the directional coupler illustrated in FIG. 1 but does not include low pass filters and a high pass filter.
Figure 3:
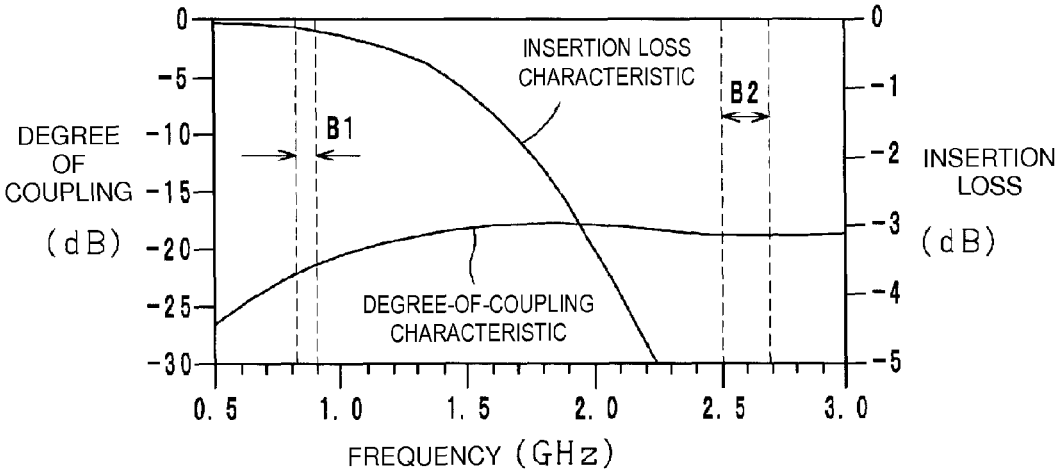
FIG. 3 is a graph illustrating an insertion loss characteristic and a degree-of-coupling characteristic of a directional coupler, which is the same as the directional coupler illustrated in FIG. 1 but does not include the high pass filter.
Figure 4:
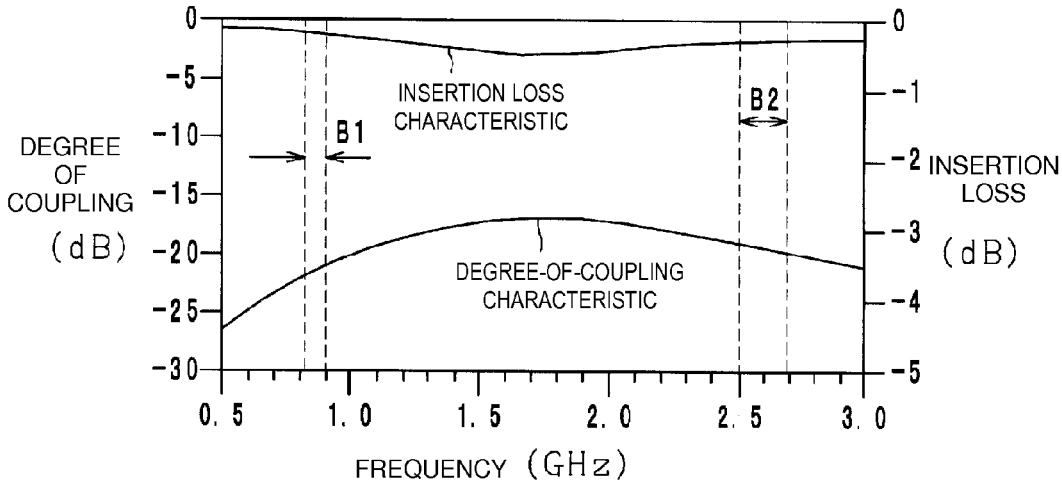
FIG. 4 is a graph illustrating an insertion loss characteristic and a degree-of-coupling characteristic of the directional coupler illustrated in FIG. 1.

The directional coupler 10 having the above-described circuit configuration achieves a degree-of-coupling characteristic close to uniform, as described below. FIG. 2 is a graph illustrating an insertion loss characteristic and a degree-of-coupling characteristic of an existing directional coupler, which is the same as the directional coupler 10 illustrated in FIG. 1 but does not include the low pass filters LPF1 and LPF2 and the high pass filter HPF. FIG. 3 is a graph illustrating an insertion loss characteristic and a degree-of-coupling characteristic of a directional coupler, which is the same as the directional coupler 10 illustrated in FIG. 1 but does not include the high pass filter HPF. FIG. 4 is a graph illustrating an insertion loss characteristic and a degree-of-coupling characteristic of the directional coupler 10 illustrated in FIG. 1. FIGS. 2 to 4 each illustrate a simulation result. The insertion loss characteristic is the relationship between frequency and a value of the ratio of the power of a high-frequency signal output from the outer electrode 14*b* (output port) to the power of a high-frequency signal input from the outer electrode 14*a* (input port) (that is, attenuation). The degree-of-coupling characteristic is a relationship between frequency and a value of the ratio of the power of a high-frequency signal output from the outer electrode 14*c* (coupling port) to the power of a high-frequency signal input to the outer electrode 14*a* (input port) (that is, attenuation). In FIGS. 2 to 4, the vertical axis represents insertion loss and degree of coupling, and the horizontal axis represents frequency.

In the existing directional coupler, the degree of coupling between the main line and the sub line increases as the frequency of a high-frequency signal increases. Hence, as illustrated in FIG. 2, in the degree-of-coupling characteristic of the existing directional coupler, a value of the ratio of the power of a high-frequency signal output from the coupling port to the power of a high-frequency signal input from the input port increases as the frequency increases. As a result, the case where a high-frequency signal in the frequency band B1 is input to the input port and the case where a high-frequency signal in the frequency band B2 is input to the input port differ from each other in terms of the power of a high-frequency signal output from the coupling port even when these high-frequency signals have the same power.

Thus, in the directional coupler 10, the low pass filter LPF1 is connected between the outer electrode 14*a* and the main line M, and the low pass filter LPF2 is connected between the outer electrode 14*b* and the main line M. The low pass filters LPF1 and LPF2 have an insertion loss characteristic in which attenuation increases with increasing frequency in the certain frequency band. Hence, as the frequency of a high-frequency signal input from the outer electrode 14*a* increases, the power of the high-frequency signal that flows through the low pass filters LPF1 and LPF2 to the ground, to which the outer electrodes 14*e* and 14*f* are connected, increases. For this reason, in a high frequency range, the power of a high-frequency signal that passes through the main line M becomes smaller than that in a low frequency range. As a result, as illustrated in FIG. 3, in the directional coupler 10, the degree-of-coupling characteristic is close to uniform.

However, in the directional coupler, which is the same as the directional coupler 10 but does not include the high pass filter HPF, as illustrated in FIG. 3, the attenuation of the insertion loss characteristic increases as the frequency of a high-frequency signal input from the outer electrode 14*a* increases. For this reason, the case where a high-frequency signal in the frequency band B1 is input to the input port and the case where a high-frequency signal in the frequency band B2 is input to the input port differ from each other in terms of the power of a high-frequency signal output from the output port even when these high-frequency signals have the same power.

Thus, in the directional coupler 10, the high pass filter HPF is connected, in parallel to the main line M, between a point between the coil L1 and the outer electrode 14*a* and a point between the coil L2 and the outer electrode 14*b*. The high pass filter HPF has a characteristic in which attenuation decreases with increasing frequency in the certain frequency band. Hence, when the frequency of a high-frequency signal input from the outer electrode 14*a* increases, the high-frequency signal is almost entirely prevented pass through the low pass filters LPF1 and LPF2 and the main line M, and passes through the high pass filter HPF. As a result, as illustrated in FIG. 4, in the directional coupler 10, the insertion loss characteristic becomes more uniform than that in the case where the high pass filter HPF is not included.

Figure 5:
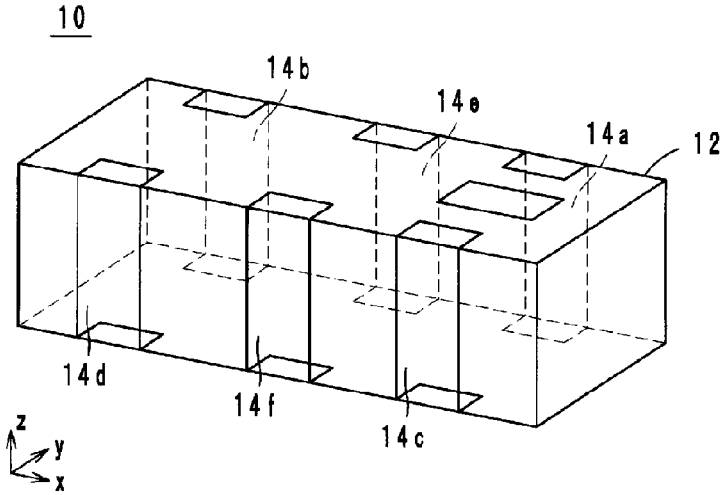
FIG. 5 is an external perspective view of the directional coupler illustrated in FIG. 1.
Figure 6:
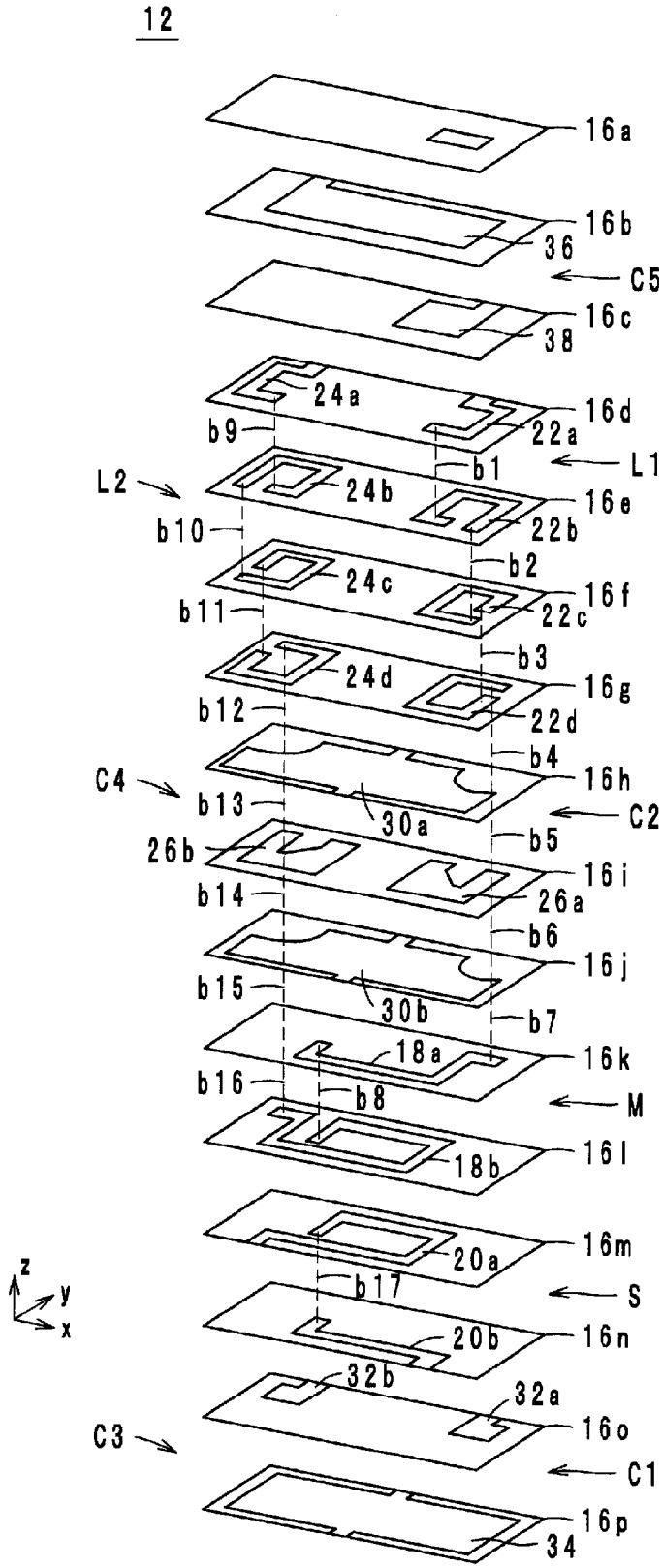
FIG. 6 is an exploded perspective view of a multilayer body of the directional coupler illustrated in FIG. 1.

Next, a specific configuration of the directional coupler 10 will be described with reference to the drawings. FIG. 5 is an external perspective view of the directional coupler 10 illustrated in FIG. 1. FIG. 6 is an exploded perspective view of a multilayer body 12 of the directional coupler 10 illustrated in FIG. 1. Hereinafter, the stacking direction is defined as a z-axis direction, the long-side direction of the directional coupler 10 when viewed in plan from the z-axis direction is defined as an x-axis direction, and the short-side direction of the directional coupler 10 when viewed in plan from the z-axis direction is defined as a y-axis direction. The x, y, and z axes are orthogonal to one another.

As illustrated in FIGS. 5 and 6, the directional coupler 10 includes the multilayer body 12, the outer electrodes 14 (14*a* to 14*f*), the main line M, the sub line S, the coils L1 and L2, and the capacitors C1 to C5. The multilayer body 12, as illustrated in FIG. 5, preferably has a rectangular or substantially rectangular parallelepiped shape, and, as illustrated in FIG. 6, includes insulator layers 16 (16*a* to 16*p*) stacked in this order from the positive side to the negative side in the z-axis direction. The insulator layers 16 preferably are made of a dielectric ceramic and each have a rectangular or substantially rectangular shape.

The outer electrodes 14*a*, 14*e*, and 14*b* are provided on a side surface of the multilayer body 12 on the positive side in the y-axis direction so as to be arranged in this order from the positive side to the negative side in the x-axis direction. The outer electrodes 14*c*, 14*f*, and 14*d* are provided on a side surface of the multilayer body 12 on the negative side in the y-axis direction so as to be arranged in this order from the positive side to the negative side in the x-axis direction.

As illustrated in FIG. 6, the sub line S includes line portions 20 (20*a* and 20*b*) and a via hole conductor b17, and has a spiral shape that spirals counterclockwise going from the positive side to the negative side in the z-axis direction. Here, in the sub line S, an end portion on the upstream side in the counterclockwise direction is termed an upstream end and an end portion on the downstream side in the counterclockwise direction is termed a downstream end. The line portion 20*a* is a linear conductor layer that is provided on the insulator layer 16*m* and the upstream end thereof is connected to the outer electrode 14*d*. The line portion 20*b* is a linear conductor layer that is provided on the insulator layer 16*n* and the downstream end thereof is connected to the outer electrode 14*c*. The via hole conductor b17 extends through the insulator layer 16*m* in the z-axis direction and connects the downstream end of the line portion 20*a* and the upstream end of the line portion 20*b* to each other. Thus, the sub line S is connected between the outer electrodes 14*c* and 14*d*.

As illustrated in FIG. 6, the main line M includes line portions 18 (18*a* and 18*b*) and via hole conductors b6 to b8 and b14 to b16, and has a spiral shape that spirals clockwise going from the positive side to the negative side in the z-axis direction. That is, the main line M spirals in a direction opposite to that in which the sub line S spirals. In addition, a region surrounded by the main line M and a region surrounded by the sub line S are superposed with each other when viewed in plan from the z-axis direction. That is, the main line M and the sub line S face each other with the insulator layer 16*l* interposed therebetween. Thus, the main line M and the sub line S are electromagnetically coupled to each other. Here, in the main line M, an end portion on the upstream side in the clockwise direction is termed an upstream end and an end portion on the downstream side in the clockwise direction is termed a downstream end. The line portion 18*a* is a linear conductor layer that is provided on the insulator layer 16*k*. The line portion 18*b* is a linear conductor layer that is provided on the insulator layer 16*l*. The via hole conductor b8 extends through the insulator layer 16*k* in the z-axis direction and connects the downstream end of the line portion 18*a* and the upstream end of the line portion 18*b* to each other. The via hole conductors b6 and b7 extend through the insulator layers 16*i* and 16*j* in the z-axis direction and are connected to each other. The via hole conductor b7 is connected to the upstream end of the line portion 18*a*. The via hole conductors b14 to b16 extend through the insulator layers 16*i* to 16*k* in the z-axis direction and are connected to one another. The via hole conductor b16 is connected to the downstream end of the line portion 18*b*.

The low pass filter LPF1 includes the coil L1 and the capacitors C1 and C2. The coil L1 includes line portions 22 (22*a* to 22*d*) and via hole conductors b1 to b5, and has a spiral shape that spirals clockwise going from the positive side to the negative side in the z-axis direction. Here, in the coil L1, an end portion on the upstream side in the clockwise direction is termed an upstream end and an end portion on the downstream side in the clockwise direction is termed a downstream end. The line portion 22*a* is a linear conductor layer that is provided on the insulator layer 16*d* and the upstream end thereof is connected to the outer electrode 14*a*. The line portions 22*b* to 22*d* are linear conductor layers that are provided on the insulator layers 16*e* to 16*g*, respectively. The via hole conductor b1 extends through the insulator layer 16*d* in the z-axis direction and connects the downstream end of the line portion 22*a* and the upstream end of the line portion 22*b* to each other. The via hole conductor b2 extends through the insulator layer 16*e* in the z-axis direction and connects the downstream end of the line portion 22*b* and the upstream end of the line portion 22*c* to each other. The via hole conductor b3 extends through the insulator layer 16*f* in the z-axis direction and connects the downstream end of the line portion 22*c* and the upstream end of the line portion 22*d* to each other. The via hole conductors b4 and b5 respectively extend through the insulator layers 16*g* and 16*h* in the z-axis direction and are connected to each other. The via hole conductor b4 is connected to the downstream end of the line portion 22*d*. The via hole conductor b5 is connected to the via hole conductor b6. Thus, the coil L1 is connected between the main line M and the outer electrode 14*a*.

The capacitor C1 includes a capacitor conductor layer 32*a* and a ground conductor layer 34. The capacitor conductor layer 32*a* is provided on the insulator layer 16*o* and is connected to the outer electrode 14*a*. The ground conductor layer 34 is provided on the insulator layer 16*p* and preferably has a rectangular or substantially rectangular shape that covers substantially the entire surface of the insulator layer 16*p*. Thus, the capacitor conductor layer 32*a* and the ground conductor layer 34 face each other with the insulator layer 16*o* interposed therebetween and a capacitance is generated between the capacitor conductor layer 32*a* and the ground conductor layer 34. The ground conductor layer 34 is connected to the outer electrodes 14*e* and 14*f*. Hence, the capacitor C1 is connected between the outer electrode 14*a* and the outer electrodes 14*e* and 14*f*. That is, the capacitor C1 is connected between a point between the coil L1 and the outer electrode 14*a*, and the outer electrodes 14*e* and 14*f*.

The capacitor C2 includes a capacitor conductor layer 26*a* and ground conductor layers 30*a* and 30*b*. The capacitor conductor layer 26*a* is provided on the insulator layer 16*i* and is connected to the via hole conductors b5 and b6. The ground conductor layers 30*a* and 30*b* are provided on the insulator layers 16*h* and 16*j* and preferably have rectangular or substantially rectangular shapes that cover substantially the entire surfaces of the insulator layers 16*h* and 16*j*, respectively. Thus, the capacitor conductor layer 26*a* faces the ground conductor layers 30*a* and 30*b* with the insulator layers 16*h* and 16*i* interposed between the capacitor conductor layer 26*a* and the ground conductor layers 30*a* and 30*b*, and capacitances are generated between the capacitor conductor layer 26*a* and the ground conductor layers 30*a* and 30*b*. The ground conductor layers 30*a* and 30*b* are connected to the outer electrodes 14*e* and 14*f*. Hence, the capacitor C2 is connected between a point between the coil L1 and the main line M, and the outer electrodes 14*e* and 14*f*.

The low pass filter LPF2 includes the coil L2 and the capacitors C3 and C4. The low pass filter LPF2 has a structure that is symmetric to the low pass filter LPF1 with respect to the perpendicular bisector of the long sides of each of the insulator layers 16 when viewed in plan from the z-axis direction.

The coil L2 includes line portions 24 (24*a* to 24*d*) and via hole conductors b9 to b13, and has a spiral shape that spirals counterclockwise going from the positive side to the negative side in the z-axis direction. Here, in the coil L2, an end portion on the upstream side in the counterclockwise direction is termed an upstream end and an end portion on the downstream side in the counterclockwise direction is termed a downstream end. The line portion 24*a* is a linear conductor layer that is provided on the insulator layer 16*d* and the upstream end thereof is connected to the outer electrode 14*b*. The line portions 24*b* to 24*d* are linear conductor layers that are provided on the insulator layers 16*e* to 16*g*, respectively. The via hole conductor b9 extends through the insulator layer 16*d* in the z-axis direction and connects the downstream end of the line portion 24*a* and the upstream end of the line portion 24*b* to each other. The via hole conductor b10 extends through the insulator layer 16*e* in the z-axis direction and connects the downstream end of the line portion 24*b* and the upstream end of the line portion 24*c* to each other. The via hole conductor b11 extends through the insulator layer 16*f* in the z-axis direction and connects the downstream end of the line portion 24*c* and the upstream end of the line portion 24*d* to each other. The via hole conductors b12 and b13 respectively extend through the insulator layers 16*g* and 16*h* in the z-axis direction and are connected to each other. The via hole conductor b12 is connected to the downstream end of the line portion 24*d*. The via hole conductor b13 is connected to the via hole conductor b14. Thus, the coil L2 is connected between the main line M and the outer electrode 14*b*.

The capacitor C3 includes a capacitor conductor layer 32*b* and the ground conductor layer 34. The capacitor conductor layer 32*b* is provided on the insulator layer 16*o* and is connected to the outer electrode 14*b*. The ground conductor layer 34 is provided on the insulator layer 16*p* and preferably has a rectangular or substantially rectangular shape that covers substantially the entire surface of the insulator layer 16*p*. Thus, the capacitor conductor layer 32*b* and the ground conductor layer 34 face each other with the insulator layer 16*o* interposed therebetween and a capacitance is generated between the capacitor conductor layer 32*b* and the ground conductor layer 34. The ground conductor layer 34 is connected to the outer electrodes 14*e* and 14*f*. Hence, the capacitor C3 is connected between the outer electrode 14*b* and the outer electrodes 14*e* and 14*f*. That is, the capacitor C3 is connected between a point between the coil L2 and the outer electrode 14*b*, and the outer electrodes 14*e* and 14*f*.

The capacitor C4 includes a capacitor conductor layer 26*b* and the ground conductor layers 30*a* and 30*b*. The capacitor conductor layer 26*b* is provided on the insulator layer 16*i* and is connected to the via hole conductors b13 and b14. The ground conductor layers 30*a* and 30*b* are provided on the insulator layers 16*h* and 16*j* and preferably have rectangular or substantially rectangular shapes that cover substantially the entire surfaces of the insulator layers 16*h* and 16*j*, respectively. Thus, the capacitor conductor layer 26*b* faces the ground conductor layers 30*a* and 30*b* with the insulator layers 16*h* and 16*i* interposed between the capacitor conductor layer 26*b* and the ground conductor layers 30*a* and 30*b*, and capacitances are generated between the capacitor conductor layer 26*b* and the ground conductor layers 30*a* and 30*b*. The ground conductor layers 30*a* and 30*b* are connected to the outer electrodes 14*e* and 14*f*. Hence, the capacitor C4 is connected between a point between the coil L2 and the main line M, and the outer electrodes 14*e* and 14*f*.

The capacitor C5 includes capacitor conductor layers 36 and 38. The capacitor conductor layer 36 is provided on the insulator layer 16*b* and is connected to the outer electrode 14*b*. The capacitor conductor layer 38 is provided on the insulator layer 16*c* and is connected to the outer electrode 14*a*. The capacitor conductor layer 36 and the capacitor conductor layer 38 face each other with the insulator layer 16*b* interposed therebetween and a capacitance is generated between the capacitor conductor layer 36 and the capacitor conductor layer 38. Hence, the capacitor C5 is connected, in parallel to the main line M, between a point between the coil L1 and the outer electrode 14*a* and a point between the coil L2 and the outer electrode 14*b*.

The above-described directional coupler 10 achieves a degree-of-coupling characteristic that is close to uniform. More specifically, in the directional coupler 10, the low pass filter LPF1 is connected between the outer electrode 14*a* and the main line M, and the low pass filter LPF2 is connected between the outer electrode 14*b* and the main line M. The low pass filters LPF1 and LPF2 have an insertion loss characteristic in which attenuation increases with increasing frequency in the certain frequency band. Hence, as the frequency of a high-frequency signal input from the outer electrode 14*a* increases, the power of the high-frequency signal that flows through the low pass filters LPF1 and LPF2 to the ground, to which the outer electrodes 14*e* and 14*f* are connected, increases. For this reason, the power of the high-frequency signal that passes through the main line M becomes small. As a result, as illustrated in FIG. 3, in the directional coupler 10, the degree-of-coupling characteristic is close to uniform.

In addition, in the directional coupler 10, the high pass filter HPF is connected, in parallel to the main line M, between a point between the coil L1 and the outer electrode 14*a* and a point between the coil L2 and the outer electrode 14*b*. The high pass filter HPF has a characteristic in which attenuation decreases with increasing frequency in the certain frequency band. Hence, when the frequency of a high-frequency signal input from the outer electrode 14*a* increases, the high-frequency signal is almost entirely prevented from passing through the low pass filters LPF1 and LPF2 and the main line M, and passes through the high pass filter HPF. As a result, as illustrated in FIG. 4, in the directional coupler 10, the insertion loss characteristic becomes more uniform than that in the case where the high pass filter HPF is not included.

In the directional coupler 10, as illustrated in FIG. 6, the ground conductor layers 30*a* and 30*b* are preferably provided between the coils L1 and L2, and the main line M and the sub line S. Consequently, the influence of an electric field and a magnetic field which are generated by the coils L1 and L2 on the main line M and the sub line S, and the influences of an electric field and a magnetic field which are generated by the main line M and the sub line S on the coils L1 and L2 are significantly reduced or prevented.

In the directional coupler 10, among the conductor layers provided on the insulator layers 16, the ground conductor layer 34 is provided on the most negative side in the z-axis direction (the lowest side in the stacking direction). This prevents leakage of an electric field and a magnetic field which are generated in the directional coupler 10 to outside the directional coupler 10 and prevents penetration of an electric field and a magnetic field from outside the directional coupler 10 into the directional coupler 10.

In the directional coupler 10, as illustrated in FIG. 1, the capacitor C5 is connected on the outer electrode 14*a* side with respect to the capacitor C1 and is connected on the outer electrode 14*b* side with respect to the capacitor C3. Alternatively, in the directional coupler 10, the capacitor C5 may be connected on the coil L1 side with respect to the capacitor C1 and be connected on the coil L2 side with respect to the capacitor C3.

The low pass filters LPF1 and LPF2 preferably are π-type low pass filters, or alternatively, may be T-type low pass filters or L-type low pass filters, for example.

The high pass filter HPF preferably includes the capacitor C5, or alternatively, may include another high pass filter in which, for example, a plurality of capacitors are provided.

As described above, preferred embodiments of the present invention are useful for directional couplers and are particularly excellent in that a degree-of-coupling characteristic is close to uniform.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A directional coupler that is used in a certain frequency band, the directional coupler comprising:

a first terminal;

a second terminal;

a third terminal;

a fourth terminal;

a main line that is connected between the first terminal and the second terminal;

a sub line that is connected between the third terminal and the fourth terminal and that is electromagnetically coupled to the main line;

a first low pass filter that includes a first coil which is connected between the first terminal and the main line and that has a characteristic in which attenuation increases with increasing frequency in the certain frequency band;

a second low pass filter that includes a second coil which is connected between the second terminal and the main line and that has a characteristic in which attenuation increases with increasing frequency in the certain frequency band; and a high pass filter that is connected, in parallel to the main line, between a point between the first coil and the first terminal and a point between the second coil and the second terminal and that has a characteristic in which attenuation decreases with increasing frequency in the certain frequency band.

2. The directional coupler according to claim 1, wherein the first terminal is an input terminal to which a signal is input;

the second terminal is a first output terminal from which the signal is output;

the third terminal is a second output terminal from which a signal having power proportional to power of the signal is output; and the fourth terminal is a termination terminal that is terminated.

3. The directional coupler according to claim 1, wherein the first low pass filter and the second low pass filter have the same characteristic.

4. The directional coupler according to claim 1, further comprising:

a multilayer body that includes a plurality of insulator layers stacked on top of one another; wherein the main line, the sub line, the first low pass filter, the second low pass filter, and the high pass filter are constituted by conductor layers provided on the insulator layers.

5. The directional coupler according to claim 4, wherein a conductor layer provided between the first coil and the second coil, and the main line and the sub line, is a first ground conductor layer that is maintained at a ground potential.

6. The directional coupler according to claim 4, wherein, among the conductor layers provided on the insulator layers, a conductor layer provided on a lowest side in a stacking direction is a second ground conductor layer that is maintained at a ground potential.

7. The directional coupler according to claim 4, wherein the first low pass filter and the second low pass filter have structures that are line-symmetric to each other.

8. The directional coupler according to claim 1, wherein the certain frequency band is 824 MHz to 2690 MHz.

9. The directional coupler according to claim 1, wherein the first low pass filter is one of a π-type low pass filter, a coil T-type low pass filter, and a L-type low pass filter.

10. The directional coupler according to claim 1, wherein the second low pass filter is one of a π-type low pass filter, a coil T-type low pass filter, and a L-type low pass filter.

11. The directional coupler according to claim 1, wherein the high pass filter includes a capacitor.

12. The directional coupler according to claim 1, wherein a degree-of-coupling characteristic of the directional coupler is approximately uniform.

13. The directional coupler according to claim 4, wherein the multilayer body has a rectangular or substantially rectangular parallelepiped shape, and the insulator layers are made of a dielectric ceramic and each have a rectangular or substantially rectangular shape.

14. The directional coupler according to claim 1, wherein the sub line includes a via hole conductor and linear conductor layers connected by the via hole conductor so as to define a spiral shape.

15. The directional coupler according to claim 1, wherein the main line includes via hole conductors and linear conductor layers connected by the via hole conductors so as to define a spiral shape.

16. The directional coupler according to claim 1, wherein the first low pass filter includes via hole conductors and linear conductor layers connected by the via hole conductors so as to define a spiral shape.

17. The directional coupler according to claim 1, wherein the second low pass filter includes via hole conductors and linear conductor layers connected by the via hole conductors so as to define a spiral shape.

18. The directional coupler according to claim 4, wherein the first lower pass filter and the second low pass filter are structurally symmetric to each other with respect to a perpendicular bisector of longer sides of each of the insulator layers when viewed in plan.

* * * * *